US011333007B2

(12) United States Patent
Coffin et al.

(10) Patent No.: US 11,333,007 B2
(45) Date of Patent: May 17, 2022

(54) MULTIPLE SHUNT PRESSURE ASSEMBLY FOR GRAVEL PACKING

(71) Applicant: Halliburton Energy Services, Inc., Houston, TX (US)

(72) Inventors: Maxime Philippe Coffin, Frisco, TX (US); Thomas Jules Frosell, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/347,711

(22) PCT Filed: Mar. 28, 2019

(86) PCT No.: PCT/US2019/024626
§ 371 (c)(1),
(2) Date: May 6, 2019

(87) PCT Pub. No.: WO2019/245623
PCT Pub. Date: Dec. 26, 2019

(65) Prior Publication Data

US 2021/0277750 A1 Sep. 9, 2021

Related U.S. Application Data

(60) Provisional application No. 62/688,813, filed on Jun. 22, 2018.

(51) Int. Cl.
*E21B 43/04* (2006.01)
*E21B 43/08* (2006.01)
*E21B 43/10* (2006.01)

(52) U.S. Cl.
CPC ..... *E21B 43/04* (2013.01); *E21B 43/086* (2013.01); *E21B 43/10* (2013.01)

(58) Field of Classification Search
CPC ..... E21B 17/02; E21B 43/04; E21B 43/08; E21B 43/086; E21B 43/10
See application file for complete search history.

(56) References Cited

U.S. PATENT DOCUMENTS 6,588,506 B2 7/2003 Jones
7,100,690 B2 * 9/2006 Mullen ..... E21B 17/028 166/236

(Continued)

FOREIGN PATENT DOCUMENTS

AU 2010237000 A1 * 10/2011 ..... E21B 43/04
FR 3091309 A1 * 7/2020 ..... E21B 43/045

(Continued)

OTHER PUBLICATIONS

International Search Report and Written Opinion issued for International Patent Application No. PCT/US2019/024626, dated Aug. 7, 2019, 20 pages.

*Primary Examiner* — Jennifer H Gay
(74) *Attorney, Agent, or Firm* — Haynes and Boone, LLP

(57) ABSTRACT

A lower completion assembly made up of an upper sand screen assembly and a lower sand screen assembly. Each sand screen assembly includes a shunt system. Each shunt system includes a transport tube and a packing tube extending from a junction block. Each packing tube includes a plurality of nozzles spaced apart from the junction block and from each other. The shunt system of the upper sand screen assembly has a higher pressure rating than the shunt system of the lower sand screen assembly. The wall thickness of the transport tubes of the upper sand screen assembly shunt system is greater than the wall thickness of the transport tubes of the lower sand screen assembly shunt system.

23 Claims, 5 Drawing Sheets

(56) References Cited

U.S. PATENT DOCUMENTS 7,497,267 B2 * 3/2009 Setterberg, Jr. ..... E21B 17/02 166/227
7,984,760 B2 * 7/2011 Haeberle ..... E21B 43/08 166/278
8,127,831 B2 * 3/2012 Haeberle ..... E21B 43/08 166/51
8,893,789 B2 * 11/2014 Cunningham ..... E21B 43/08 166/278
8,967,240 B2 * 3/2015 Cunningham ..... E21B 43/086 166/51
9,074,458 B2 * 7/2015 Cunningham ..... E21B 43/04
9,133,705 B2 * 9/2015 Angeles Boza ..... E21B 47/12
9,260,953 B2 * 2/2016 Cunningham ..... E21B 43/04
9,638,011 B2 * 5/2017 Cleveland ..... E21B 23/06
9,638,012 B2 * 5/2017 Yeh ..... E21B 43/086
9,670,756 B2 * 6/2017 Yeh ..... E21B 43/04
9,725,988 B2 * 8/2017 Gano ..... E21B 43/08
10,100,616 B2 * 10/2018 Veit ..... F16L 21/08
2002/0174984 A1 * 11/2002 Jones ..... E21B 43/04 166/278
2003/0029613 A1 2/2003 Danos et al.
2004/0140089 A1 * 7/2004 Gunneroed ..... E21B 43/08 166/228
2008/0128129 A1 * 6/2008 Yeh ..... E21B 43/08 166/275
2008/0142227 A1 * 6/2008 Yeh ..... E21B 43/04 166/369
2009/0008092 A1 * 1/2009 Haeberle ..... E21B 43/08 166/278
2009/0294128 A1 * 12/2009 Dale ..... E21B 33/127 166/306
2010/0139919 A1 * 6/2010 Yeh ..... E21B 43/04 166/278
2011/0162840 A1 * 7/2011 Haeberle ..... E21B 33/12 166/278
2013/0008652 A1 1/2013 Broussard et al.
2013/0220635 A1 * 8/2013 Greci ..... E21B 19/16 166/380
2013/0327542 A1 * 12/2013 Least ..... E21B 43/04 166/380
2014/0014314 A1 * 1/2014 Cunningham ..... E21B 43/08 166/51
2014/0110131 A1 * 4/2014 Cunningham ..... 166/378
2014/0158373 A1 * 6/2014 Least ..... E21B 43/084 166/380
2014/0262208 A1 * 9/2014 Cunningham ..... E21B 43/12 166/115
2014/0332211 A1 * 11/2014 Cunningham ..... E21B 43/04 166/278
2015/0027700 A1 * 1/2015 Riisem ..... E21B 43/04 166/278
2015/0129194 A1 * 5/2015 Veit ..... E21B 43/088 166/51
2015/0285038 A1 * 10/2015 Yeh ..... E21B 43/04 166/278
2015/0345257 A1 * 12/2015 Veit ..... E21B 17/02 166/378
2016/0003014 A1 * 1/2016 Gano ..... E21B 43/08 166/278
2016/0215570 A1 * 7/2016 Molina ..... E21B 17/18
2016/0251913 A1 * 9/2016 Least ..... E21B 17/02 166/242.3
2017/0022789 A1 * 1/2017 Hodge ..... E21B 43/045
2019/0145231 A1 * 5/2019 Sessa ..... E21B 43/045 166/51
2019/0145232 A1 * 5/2019 Sessa ..... E21B 43/08 166/51
2019/0284913 A1 * 9/2019 Frosell ..... E21B 43/086
2021/0002987 A1 * 1/2021 Langlais ..... E21B 43/086
2021/0123327 A1 * 4/2021 Langlais ..... E21B 17/18
2021/0277750 A1 * 9/2021 Coffin ..... E21B 43/086

FOREIGN PATENT DOCUMENTS

WO WO 2013/187878 A1 12/2013
WO WO-2013187877 A1 * 12/2013 ..... E21B 43/08
WO WO-2014062180 A1 * 4/2014 ..... E21B 43/04
WO WO-2014088594 A1 * 6/2014 ..... E21B 43/04
WO WO-2019245623 A1 * 12/2019 ..... E21B 43/10
WO WO-2020142076 A1 * 7/2020 ..... E21B 43/08

* cited by examiner

MULTIPLE SHUNT PRESSURE ASSEMBLY FOR GRAVEL PACKING

CROSS-REFERENCE TO RELATED APPLICATION

The present application is a U.S. National Stage patent application of International Application No. PCT/US2019/024626, filed on Mar. 28, 2019, which claims the benefit of U.S. Provisional Application No. 62/688,813, filed Jun. 22, 2018, both entitled "MULTIPLE SHUNT PRESSURE ASSEMBLY FOR GRAVEL PACKING," the disclosures of which are hereby incorporated by reference in their entirety.

FIELD OF INVENTION

The present disclosure relates to screen assemblies of lower production systems used in wellbore gravel packing, and more particularly to shunt tube systems utilized in the sand screen assemblies.

BACKGROUND

In the course of completing an oil and/or gas well, a string of production tubing can be run into the wellbore. During production of the formation fluid, formation sand may be swept into the flow path of the production fluid as it passes along the tubing string. The formation sand tends to be relatively fine sand that can erode production components in the flow path.

When formation sand is expected to be encountered, one or more lower production assemblies may be installed in the production zone between the formation and the production tubing. The lower production assemblies typically include a perforated base pipe surrounded by a sand screen to filter fines from the formation fluid. A packer is customarily set above the production assembly to seal off the annulus in the production zone where formation fluids flow into the production tubing. The annulus around the sand screen can then be "gravel packed" with a relatively coarse sand (or gravel) which acts as a filter to reduce the amount of fine formation sand reaching the screen. The packing sand is pumped down the work string in a slurry of carrier fluid such as water and/or gel and fills the annulus around the sand screen. In well installations in which the screen is suspended in an uncased open bore, the sand or gravel pack may serve to support the surrounding unconsolidated formation. During the gravel packing process, a premature loss of the carrier fluid into the formation, known as leak-off, can occur, resulting in the formation of sand bridges in the annulus about the screening. With a premature loss of carrier fluid, incomplete packing around the sand screen and reduce the filtering efficiency of the gravel pack.

One conventional approach to overcoming this packing sand bridging problem has been to provide each production assembly with a series of shunt tubes that longitudinally extend through the sand screen section, with opposite ends of each shunt tube projecting outwardly beyond the active filter portion of the sand screen section. In the assembled sand screen structure, the shunt tube series are axially joined to one another to form a shunt path extending along the length of the sand screen assembly. The shunt path operates to permit the inflowing packing sand/gel slurry to bypass any sand bridges that may be formed and permit the slurry to enter the screen/casing or screen/open hole annulus beneath a sand bridge, thereby forming the desired sand pack beneath it.

In instances where production zones are elongated, a plurality of lower completion assemblies may be deployed end to end to form a lower completion assembly string that may stretch for hundreds of feet. To ensure that gravel packing slurry is deposited along the entire length of the lower completion assembly string from its upstream end to the downstream end, particularly in deep wellbores and deviated wellbores, relatively high pressures must be applied to the carrier fluid. Thus, each individual lower completion assembly utilized in the overall string is designed to withstand the high delivery pressures experienced at the upstream end of the lower completion assembly string.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
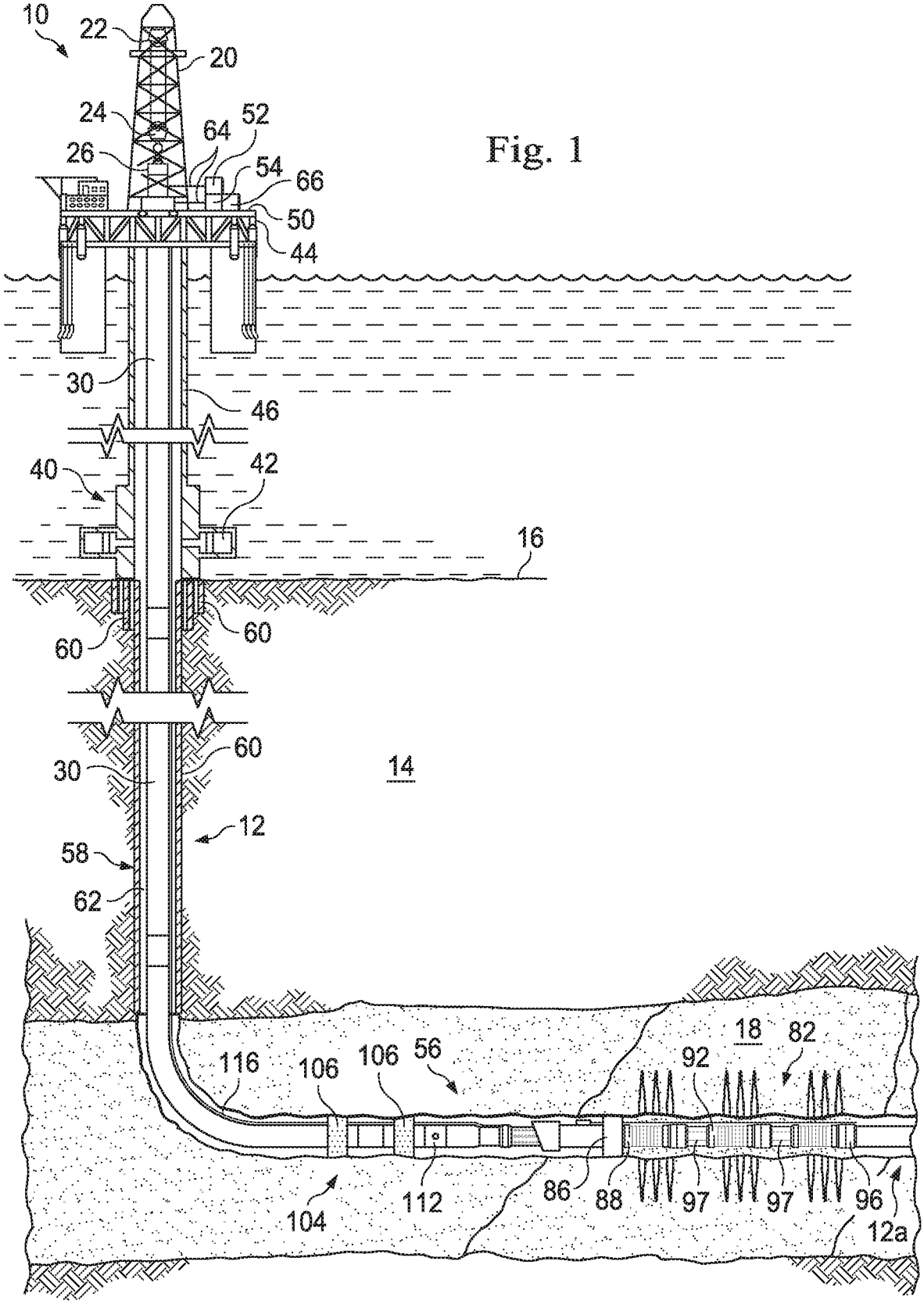
FIG. 1 is a cut-away view of a wellbore system having a lower completion system disposed therein.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover, even though a figure may depict a horizontal wellbore or a vertical wellbore, unless indicated otherwise, it should be understood by those skilled in the art that the apparatus according to the present disclosure is equally well-suited for use in wellbores having other orientations including, deviated wellbores, multilateral wellbores, or the like. Likewise, unless otherwise noted, even though a figure may depict an offshore operation, it should be understood by those skilled in the art that the apparatus according to the present disclosure is equally well-suited for use in onshore operations and vice-versa.

Generally, a lower completion assembly made up of at least two sand screen assemblies is provided, namely a first or upper sand screen assembly and a second or lower sand screen assembly. Each sand screen assembly includes a shunt system. Each shunt system includes a transport tube and a packing tube extending from a junction block. Each packing tube includes a plurality of nozzles spaced apart from the junction block and from each other. In one or more embodiments, the cross-sectional area of the transport tube in the first sand screen assembly is less than the cross-sectional area of the transport tube in the second sand screen assembly. In one or more embodiments, the cross-sectional area of the packing tube in the first sand screen assembly is less than the cross-sectional area of the packing tube in the second sand screen assembly. In one or more embodiments, the cross-sectional area of the packing tube nozzles in the first sand screen assembly is less than the cross-sectional area of the packing tube nozzles in the second sand screen assembly. In one or more embodiments, the distance between the junction block and the packing tube nozzles is greater in the first sand screen assembly than the distance between the junction block and the packing tube nozzles in the second sand screen assembly. In one or more embodiments, the distance between adjacent packing tube nozzles is greater in the first sand screen assembly than the distance between adjacent packing tube nozzles in the second sand screen assembly. In one or more embodiments, the number of packing tube nozzles in the first sand screen assembly is less than the number of packing tube nozzles in the second sand screen assembly.

Turning to FIG. 1, shown is an elevation view in partial cross-section of a wellbore production system 10 utilized to complete wells intended to produce hydrocarbons from wellbore 12 extending through various earth strata in an oil and gas formation 14 located below the earth's surface 16. Wellbore 12 may be formed of a single or multiple bores, extending into the formation 14, and disposed in any orientation, such as the horizontal wellbore 12*a* illustrated in FIG. 1. Formation 14 includes production zones 18 from which hydrocarbons are produced.

Production system 10 includes a rig or derrick 20. Rig 20 may include a hoisting apparatus 22, a travel block 24, and a swivel 26 for raising and lowering casing, drill pipe, coiled tubing, production tubing, other types of pipe or tubing strings or other types of conveyance vehicles such as wireline, slickline, and the like 30. In FIG. 1, conveyance vehicle 30 is a substantially tubular, axially extending work string or production tubing, formed of a plurality of pipe joints coupled together end-to-end supporting a completion assembly as described below.

Rig 20 may be located proximate to or spaced apart from wellhead 40, such as in the case of an offshore arrangement as shown in FIG. 1. One or more pressure control devices 42, such as blowout preventers (BOPs) and other equipment associated with drilling or producing a wellbore may also be provided at wellhead 40 or elsewhere in the system 10.

For offshore operations, as shown in FIG. 1, rig 20 may be mounted on an oil or gas platform 44, such as the offshore platform as illustrated, semi-submersibles, drill ships, and the like (not shown). Although system 10 of FIG. 1 is illustrated as being a marine-based production system, system 10 of FIG. 1 may be deployed on land. In any event, for marine-based systems, one or more subsea conduits or risers 46 extend from deck 50 of platform 44 to a subsea wellhead 40. Tubing string 30 extends down from rig 20, through subsea conduit 46 and BOP 42 into wellbore 12.

A working or service fluid source 52, such as a storage tank or vessel, may supply, via flow lines 64, a working fluid to equipment disposed in wellbore 12, such as subsurface equipment 56. Working fluid source 52 may supply any fluid utilized in wellbore operations, including without limitation, gravel packing slurry, acidizing fluid, liquid water, steam or some other type of fluid.

Production system 10 may generally be characterized as having a pipe system 58. For purposes of this disclosure, pipe system 58 may include casing, risers, tubing, drill strings, completion or production strings, subs, heads or any other pipes, tubes or equipment that couples or attaches to the foregoing, such as string 30, conduit 46, and casing. In this regard, pipe system 58 may include one or more casing strings 60 that may be cemented in wellbore 12, such as the surface, intermediate and production casings 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be. While wellbore 12 is shown as uncased in the production zone 18 and along the entire depicted portion of horizontal wellbore 12*a*, all or a portion of wellbore 12 and/or horizontal wellbore 12*a* may be cased as well and the disclosure is not limited in that regard.

Production fluids and other debris returning to surface 16 from wellbore 12 are directed by a flow line 64 to storage tanks 54 and/or processing systems 66.

As shown in FIG. 1, subsurface equipment 56 is illustrated as completion equipment and tubing string 30 in fluid communication with the completion equipment 56 is illustrated as production tubing 30. Although completion equipment 56 can be disposed in a wellbore 12 of any orientation, for purposes of illustration, completion equipment 56 is shown disposed in a substantially horizontal portion of wellbore 12 and includes a lower completion assembly 82 having various tools such as a packer 86, a sand screen assembly 88, a sand screen assembly 92, a sand screen assembly 96 and a packer 98. In embodiments where lower completion assembly 82 is deployed in a cased wellbore, an additional packer, such as packer 86, would be deployed at the distal end of the lower completion assembly. In the illustrated embodiment, packer 86 is generally located adjacent the upstream or proximal end of a production zone 18 and packer 98 is generally located adjacent the downstream or distal end of a production zone 18. Sand screen assemblies 88, 92 and 96 each include a shunt tube system 97 and are arranged so that the sand screen assembly having a shunt tube system with the highest operating pressure rating is upstream and the sand screen assembly having a shunt tube system with the lowest operating pressure rating is downstream. Thus, for example, in the illustrated embodiment sand screen assembly 88 includes a shunt tube assembly with a higher operating pressure than the shunt tube assembly of sand screen 96.

Disposed in wellbore 12 at the lower end of tubing string 30 is an upper completion assembly 104 that includes various tools such as a packer 106, and a fluid flow control module 112.

Extending uphole from upper completion assembly 104 are one or more lines 116, such as hydraulic tubing, pressurized fluid tubing and the like which extends to the surface 16.

Figure 2:
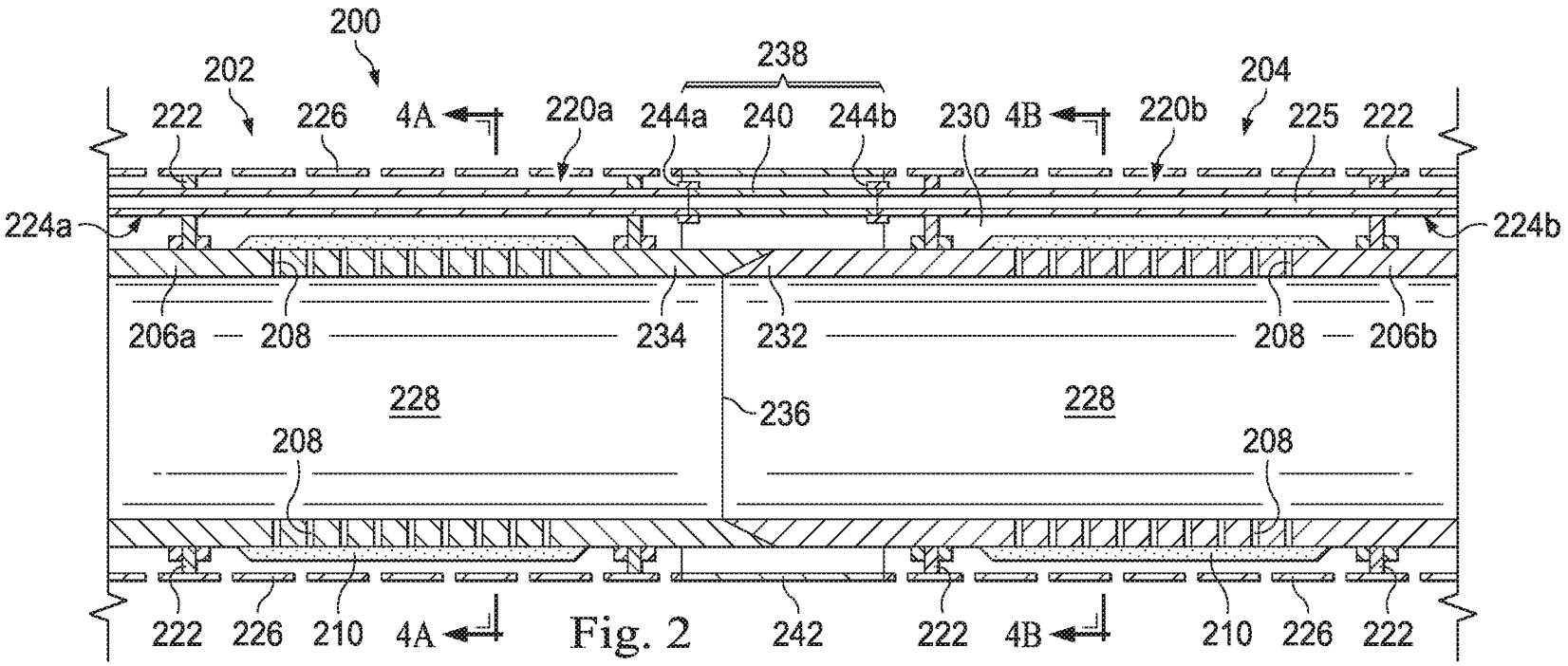
FIG. 2 is a partial cross-sectional view of a lower completion assembly.

A cross-sectional view of an embodiment of a lower completion assembly 200 is shown in FIG. 2. Lower completion assembly is generally comprised of a first sand screen assembly 202 interconnected with a second sand screen assembly 204. In some embodiments, lower completion assembly 200 may be comprised of a plurality of interconnected first sand screen assemblies 202 at an upper portion of the lower completion assembly 200 and a plurality of interconnected second sand screen assemblies 204 at a lower portion of the lower completion assembly 200. Each sand screen assembly includes a base pipe 206 having a series of perforations 208 disposed therethrough, the base pipe 206 extending between a first end and a second end. A sand screen or filter media 210 is disposed about a portion of the base pipe 206 and the series of perforations 208 in order to screen incoming fluids from the formation. Each sand screen assembly also includes a shunt tube assembly 220 disposed outwardly of the filter media 220. Generally, shunt tube assembly 220 may include one or more retaining rings 222 supporting one or more shunt tubes 224 in the form of a transport tube or a packing tube disposed along and generally parallel to the base pipe 206. Shunt tubes 224 are tubular members having a passageway 225 defined therein with a cross-sectional flow area. While shown disposed outside of and generally parallel to the base pipe 206, other positions and alignment may be possible. An outer shroud 226 may be disposed about the base pipe 206, one or more shunt tubes 224, and filter media 210. In an embodiment, the retaining rings 212 are configured to retain the one or more shunt tubes 224 and/or outer shroud 226 in position relative to the base pipe 206.

While the base pipe 206 is illustrated as being perforated in FIG. 2, the base pipe 206 may be slotted and/or include perforations of any shape so long as the perforations permit fluid communication of production fluid between an interior throughbore 228 and an exterior 230 of the screen assembly.

The filter media 210 may be disposed about the base pipe 206 and can serve to limit and/or prevent the entry of sand, formation fines, and/or other particulate matter into the base pipe 206. In an embodiment, the filter media 210 is of the type known as "wire-wrapped," since it is made up of a wire closely wrapped helically about a base pipe 206, with a spacing between the wire wraps being chosen to allow fluid flow through the filter media 210 while keeping particulates that are greater than a selected size from passing between the wire wraps. While a particular type of filter media 210 is used in describing the present invention, it should be understood that the generic term "filter media" as used herein is intended to include and cover all types of similar structures which are commonly used in gravel pack well completions which permit the flow of fluids through the filter or screen while limiting and/or blocking the flow of particulates (e.g. other commercially-available screens, slotted or perforated liners or pipes; sintered-metal screens; sintered-sized, mesh screens; screened pipes; prepacked screens and/or liners; or combinations thereof).

The base pipe 206 may generally comprise a pin end 232 and a box end 234 to allow the base pipe 206 to be coupled to an adjacent base pipe 206. In the illustrated embodiment, base pipe 206*a* of first sand screen assembly 202 is coupled to base pipe 206*b* of second sand screen assembly 204 forming a joint 236. As such, the first sand screen assembly 202 and the second sand screen assembly 204 can be joined together end-to-end so that the respective base pipes are in fluid communication with one another along their throughbores 228. As can be seen in FIG. 2, each base pipe 206 may have a coupling section 238 that extends beyond the shunt tube assembly 220 of the respective sand screen assemblies. This exposed portion of the base pipe 206 may be used during the coupling process to allow one or more tools to engage the exposed portion for makeup of the first and second sand screen assemblies 202, 204.

Shunt tubes 224 of adjacent sand screen assemblies may be joined together in fluid communication by a jumper tube 240. In the illustrated embodiment, shunt tube 224*a* is interconnected to shunt tube 224*b* by jumper tube 240. An additional shroud 242 may be used to protect jumper tube 240. While the disclosure is not limited to a particular shape for shunt tubes 224 or jumper tubes 240, in some embodiments, shunt tubes 224 may have a non-round cross-section (as shown in FIGS. 3A and 3B), while jumper tubes 240 may have a round cross-section. In such case, the end of each jump tube may include an adaptor or coupling 244 to transition from the non-round cross-section of the shunt tube 224 to the round cross-section of the jumper tubes 240.

Although the particular shape of the tubes described herein are not a limitation in certain embodiments, shunt tubes used in shunt tube systems generally have non-round cross-sectional shapes. These cross-sectional shapes allow for the shunt tubes to be arranged adjacent the wellbore tubular and provide a desired flow area without requiring an outer diameter that would otherwise be associated with the use of all round components. The jumper tubes used to couple shunt tubes on adjacent wellbore tubular joints are generally round cross-section while the shunt tubes are non-round in cross-section.

Figure 3:
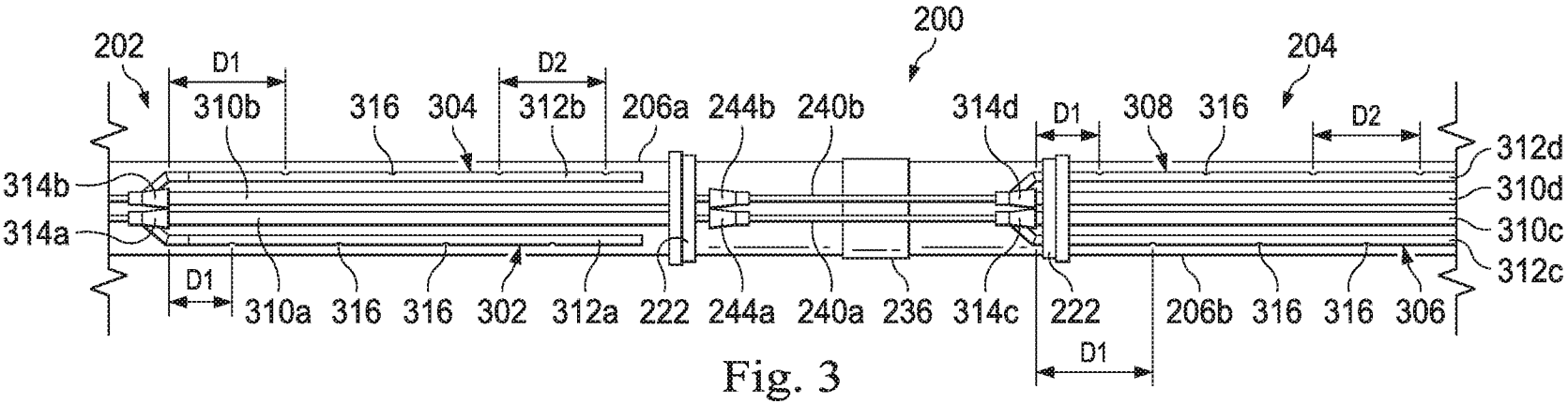
FIG. 3 is a partial side view of an embodiment of a shunt tube assembly deployed on a base pipe of a lower completion assembly.

With reference to FIG. 3, a side view of a lower completion assembly 200 is illustrated, with first sand screen assembly 202 interconnected with second sand screen assembly 204. In the illustrated embodiment, the filter media 210 and outer shrouds 226, 242 shown in FIG. 2 are removed to permit better illustration of the shunt tube assemblies. Additionally, the different types of shunt tubes 224 that comprise a shunt tube assembly 220 are illustrated in more detail. Specifically, in FIG. 3, base pipe assembly 206*a* is shown interconnected to base pipe assembly 206*b* at joint 236. First sand screen assembly 202 has two shunt tube assemblies 302 and 304. Likewise, second sand screen assembly 204 is illustrated with two shunt tube assemblies 306 and 308. Each shunt tube assembly described herein, including shunt tube assemblies 220 of FIG. 2, generally include a transport tube 310 and a packing tube 312 extending from a junction block 314 so as to be in fluid communication with one another.

As shown, the shunt tubes 310, 312 may form a branched structure from junction block 314 along the length of a sandscreen assembly 202 with the one or more transport tubes 310 forming the trunk line and the one or more packing tubes 312 forming the branch lines. In an embodiment, a plurality of branched structures may extend along the length of the sandscreen assembly 202. The use of a plurality of branched structures may provide redundancy to the shunt tubes system in the event that one of the branched structures is damaged, clogged, or otherwise prevented from operating as intended. Likewise, while junction block 314 is depicted as having only one inlet and two outlets, the disclosure is not limited to a particular junction block configuration. The "y-block" junction block depicted is for illustration purposes only unless otherwise stated for a particular configuration. In this regard, in certain configurations, the shunt tube assembly may only comprise a junction block 314 having one inlet and two outlets as depicted.

Each packing tube 312 includes one or more nozzles 316. Each nozzle 316 is spaced apart from its respective junction block 314 a distance D1. Likewise, each nozzle 316 along a packing tube 312 may be spaced apart from adjacent nozzles a distance D2. The spacing D2 between nozzles 216 along a particular packing tube 312 may be the same or different. Likewise, the spacing D2 between nozzles 216 of shunt tube assemblies of the same sand screen assembly may be the same or different.

Also shown in FIG. 3 is a jumper tube 240*a* interconnecting shunt tube assembly 302 with a shunt tube assembly 306 and a jumper tube 240*b* interconnecting shunt tube assembly 204 with shunt tube assembly 308. A coupling 244*a* is provided at distal end of transport tube 310*a* to facilitate attachment of jumper tube 240*a*, while a coupling 244*b* is provided at distal end of transport tube 310*b* to facilitate attachment of jumper tube 240*b*. In particular, jumper tube 240*a* interconnects junction block 314*c* with coupling 244*a* at the distal end of transport tube 310*a*, thereby allowing fluid communication between upper or high pressure shunt tube assembly 302 and lower or low pressure shunt tube assembly 306. Likewise, jumper tube 240*b* interconnects junction block 314*d* with coupling 244*b* at the distal end of transport tube 310*b*, spanning joint 236 between the first sand screen assembly 202 and the second sand screen assembly 204.

Figure 4A:
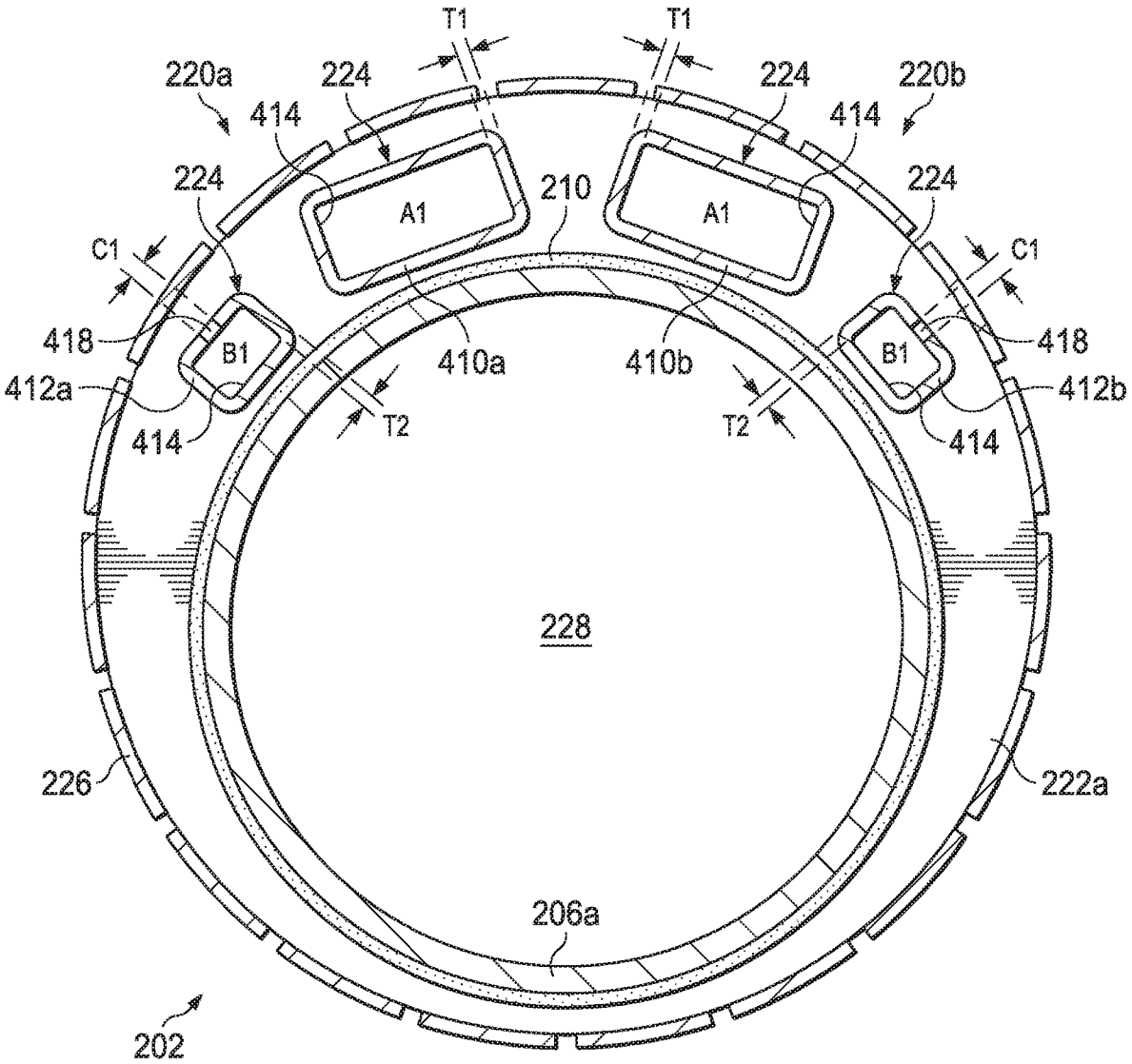
FIG. 4A is a cross-sectional view of an embodiment of a shunt tube assembly along line A-A' of FIG. 2.
Figure 4B:
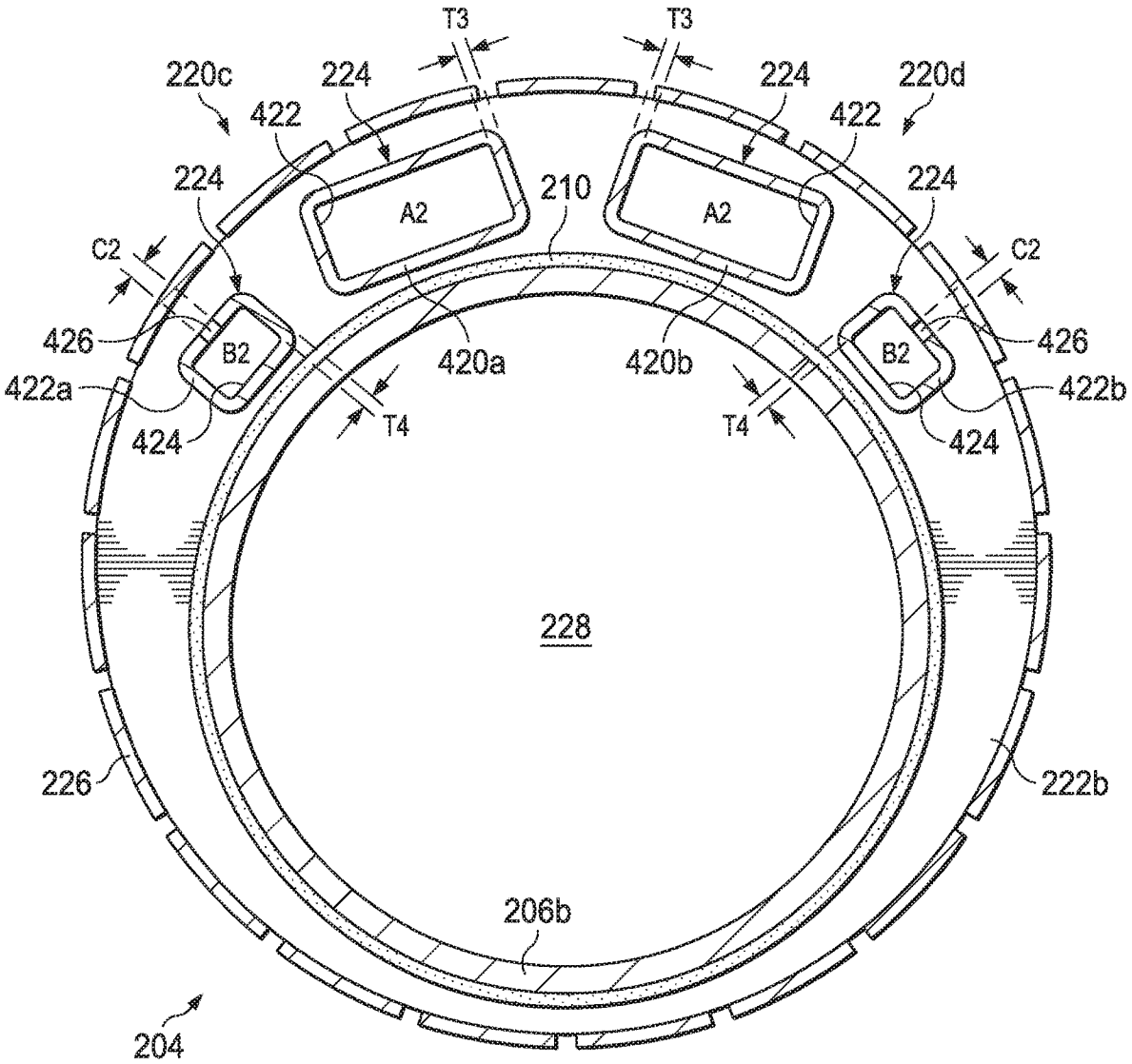
FIG. 4B is a cross-sectional view of an embodiment of a shunt tube assembly along line B-B' of FIG. 2.

FIG. 4A illustrates a cross-sectional area A-A of first sand screen assembly 202 and shunt tubes 224*a* of FIG. 2 and FIG. 4B illustrates a cross-sectional area B-B of second sand screen assembly 204 and shunt tubes 224*b* of FIG. 2. As generally shown, the one or more shunt tubes 224 generally comprise tubular members disposed outside of and generally parallel to the base pipe 224. While described as tubular members (e.g., having substantially rectangular cross-sections), the one or more shunt tubes 224 may have shapes other cross-sectional shapes, such as round, elliptical, kidney shaped, and/or trapezoidal in shape. The retaining rings 222 may retain the shunt tubes 224 in position relative to the base pipe 206. The one or more shunt tubes 224 may be eccentrically aligned with respect to the base pipe 206 as best seen in FIG. 2. In each of FIGS. 4A and 4B, four shunt tubes 224 are arranged to one side of the base pipe 206. While illustrated in FIGS. 2 and 4 as having an eccentric alignment, other alignments of the one or more shunt tubes about the base pipe 206 may also be possible.

In FIG. 4A, first sand screen assembly 202 is illustrated as having two shunt tube assemblies 220, each comprising a transport tube 410 and a packing tube 412. Each transport tube 410 has a cross-sectional flow area A1 bounded by a wall 414 of thickness T1. Likewise, each packing tube 412 has a cross-sectional flow area B1 bounded by a wall 416 of thickness T2. Each packing tube further includes one or more nozzles 418 through which fluids may flow to facilitate gravel packing. In some embodiments, nozzle 418 may be in the form of a perforation or opening in wall 416 or a short tube with a taper or constriction. Nozzle 418 is characterized by a cross-sectional flow area C1.

Similarly, in FIG. 4B, second sand screen assembly 204 is illustrated as having two shunt tube assemblies 220, each comprising a transport tube 420 and a packing tube 422. Each transport tube 420 has a cross-sectional flow area A2 bounded by a wall 422 of thickness T3. Likewise, each packing tube 422 has a cross-sectional flow area B2 bounded by a wall 424 of thickness T4. Each packing tube further includes one or more nozzles 4426 through which fluids may flow to facilitate gravel packing. In some embodiments, nozzle 426 may be in the form of a perforation or opening in wall 424 or a short tube with a taper or constriction. Nozzle 426 is characterized by a cross-sectional flow area C2.

In one or more embodiments, the cross-sectional flow area A1 of the transport tube 410 of first sand screen assembly 202 is less than the cross-sectional flow area A2 of the transport tube 420 of the second sand screen assembly 204. In other words, the downstream sand screen assembly transport tube which is closest to the distal end of the production zone, has a larger cross-sectional flow area than the upstream sand screen assembly transport tube closest to the proximal end of the production zone.

In one or more embodiments, the cross-sectional flow area B1 of the packing tube 412 of first sand screen assembly 202 is less than the cross-sectional flow area B2 of the packing tube 422 of the second sand screen assembly 204. In other words, the downstream sand screen assembly packing tube which is closest to the distal end of the production zone, has a larger cross-sectional flow area than the upstream sand screen assembly packing tube closest to the proximal end of the production zone.

In one or more embodiments, the cross-sectional flow area C1 of a nozzle 418 of first sand screen assembly 202 is less than the cross-sectional flow area C2 of a nozzle 426 of the second sand screen assembly 204. In other words, the downstream sand screen assembly shunt tube nozzles which are closest to the distal end of the production zone, have a larger cross-sectional flow area than the upstream sand screen assembly shunt tube nozzles closest to the proximal end of the production zone.

In one or more embodiments, the packing tube assembly 412 of the first sand screen assembly 202 has fewer nozzles 418 than the number of nozzles 426 of the packing tube assembly 422 of the second sand screen assembly 204.

Referring back to FIG. 3, in one or more embodiments, the distance D1 of the first nozzle 316 of packing tube assembly 312*a* from the junction block 314*a* is greater than the distance D1 of the first nozzle 316 of packing tube assembly 312*c* from the junction block 314*c* for the interconnected shunt tube assemblies 302 and 306. Likewise, the distance D1 of the first nozzle 316 of packing tube assembly 312*b* from the junction block 314*b* is greater than the distance D1 of the first nozzle 316 of packing tube assembly 312*d* from the junction block 314*d* for the interconnected shunt tube assemblies 304 and 308.

Similarly, in one or more embodiments, the distance D2 between adjacent nozzle 316 of packing tube assembly 312*a* of first sand screen assembly 202 is greater than the distance D2 between adjacent nozzle 316 of packing tube assembly 312*c* of the second sand screen assembly 204 for interconnected shunt tube assemblies 302 and 306. Likewise, the distance D2 between adjacent nozzle 316 of packing tube assembly 312*b* of first sand screen assembly 202 is greater than the distance D2 between adjacent nozzle 316 of packing tube assembly 312*d* of the second sand screen assembly 204 for interconnected shunt tube assemblies 304 and 308.

While each of the different geometries of a shunt tube assembly have been described, it will be appreciated that any one or more of the geometries can be combined to achieve the desired flow regime for a particular shunt tube assembly. In some cases, certain of the geometries will remain the same. For example, the transport tubes 410 and 420 may be the same with the same flow areas A1, A2, but the geometries of the respective packing tubes 412, 244 may differ in number of nozzles and/or cross-sectional flow areas B1, B2 and/or nozzle spacing along the respective packing tubes.

Traditionally, when a lower production assembly is installed along the length of a production zone, the lower production assembly is generally comprised of multiple sand screen assemblies with shunt tube assemblies all of the same pressure rating. In this regard, the shunt tube assemblies are selected based on the expected operating conditions of the shunt tube assemblies. For shorter gravel packing intervals, the gravel pack slurry flows into the wellbore annulus at about the same fluid pressure along the length of the interval. Of course, as gravel pack intervals have increased, an increased operating pressure is needed to ensure that gravel pack slurry flows along the entire length of the gravel pack interval. Thus, as gravel pack intervals increase, it has been necessary to employ shunt tube assemblies with increased operating pressure ratings or burst pressures, resulting in heavier and/or bulkier tubing and components to ensure that the shunt tube assemblies will not be subject to burst pressure. Since shunt tube assemblies for an entire lower production assembly are selected based on the highest operating pressure expected to be required across the entire length of the gravel packing interval, individual sand screen assemblies in a lower production assemblies have become increasingly heavier. However, as the slurry flows from the upstream portion of these elongated production zone to the downstream portion of the production zone, the pressure of the slurry drops off. As such, only the shunt tube assemblies deployed adjacent the upper portion of the production zone experience the highest pressures.

In addition, because of the high pressure experienced by shunt tube assemblies at the upper or upstream end of such lower production assemblies deployed in elongated production zones, there is a tendency for greater leak-off in the upstream portion of the production zone.

These drawbacks are addressed by above-described lower production assembly where the shunt tube system flow regime in the second sand screen assembly 204 is selected to allow a larger volume of fluid to flow therethrough than that of the first sand screen assembly 202 by adjusting cross-sectional flow areas, location and number of nozzles. In this regard, the geometries of the shunt tube assemblies 220 of the first sand screen assembly 202 may be selected to have a higher operating pressure than the shunt tube assemblies 220 of the second sandscreen assembly 204. In one or more embodiments, the thickness T1 of wall 414 of transport tube 410 of the first sand screen assembly 202 may be greater than thickness T3 of wall 422 of transport tube 420 of the second sandscreen assembly 204. Likewise, in one or more embodiments, the thickness T2 of wall 416 of packing tube 412 of the first sand screen assembly 202 may be greater than the thickness T4 of wall 424 of packing tube 422 of the second sandscreen assembly 204. In other embodiments, where geometries and dimensions are the same, the material of construction of transport tube 410 may be selected to be stronger than the material of construction of transport tube 420. In other words, the material of construction of transport tube 410 of the first sand screen assembly 202 is selected to have a higher tensile or yield strength than the material of construction of transport tube 420 of the second sandscreen assembly 204. In other embodiments, the material of construction of packing tube 412 of the first sand screen assembly 202 is selected to have a higher tensile or yield strength than the material of construction of packing tube 422 of the second sandscreen assembly 204. As such, the shunt tube assemblies 220 utilized in the first sandscreen assembly 202 may be selected to have an operating pressure at or above a select threshold, while the shunt tube assemblies 220 of the second sandscreen assembly 204 may be selected to have an operating pressure at or below a select threshold. In one or more embodiments, the shunt tube assemblies 220 utilized in the first sandscreen assembly 202 have an operating pressure or are otherwise rated at over 5000 psi while the shunt tube assemblies 220 of the second sandscreen assembly 204 have an operating pressure or are otherwise rated at no more than 5000 psi. In another embodiment, the shunt tube assemblies 220 utilized in the first sandscreen assembly 202 have an operating pressure range or rating or are otherwise rated between 5000 and 10000 psi, while the shunt tube assemblies 220 of the second sandscreen assembly 204 have an operating pressure or are otherwise rated at no more than 4000 psi. More broadly, it will be appreciated that the first and second sandscreen assemblies 202, 204 have different shunt tube assembly operating pressure ratings, with the shunt tube assembly 220 of the first sandscreen assembly 202 having a higher operating pressure rating than the shunt tube assembly 220 of the second sandscreen assembly 204.

In another embodiment, the shunt tube assemblies 220 utilized in the first sandscreen assembly 202 have an operating pressure range or rating of between approximately 6,500 to 7,500 psi, while the shunt tube assemblies 220 of the second sandscreen assembly 204 have an operating pressure of approximately 3,500 to 3,750 psi. In certain embodiments, the shunt tube assemblies 220 utilized in the first sandscreen assembly 202 have are rated at or have an operating pressure of approximately 10,000 psi. In other words, the shunt tube assemblies upstream are selected to have a higher burst pressure than the shunt tube assemblies downstream in the overall lower production assembly.

Figure 5:
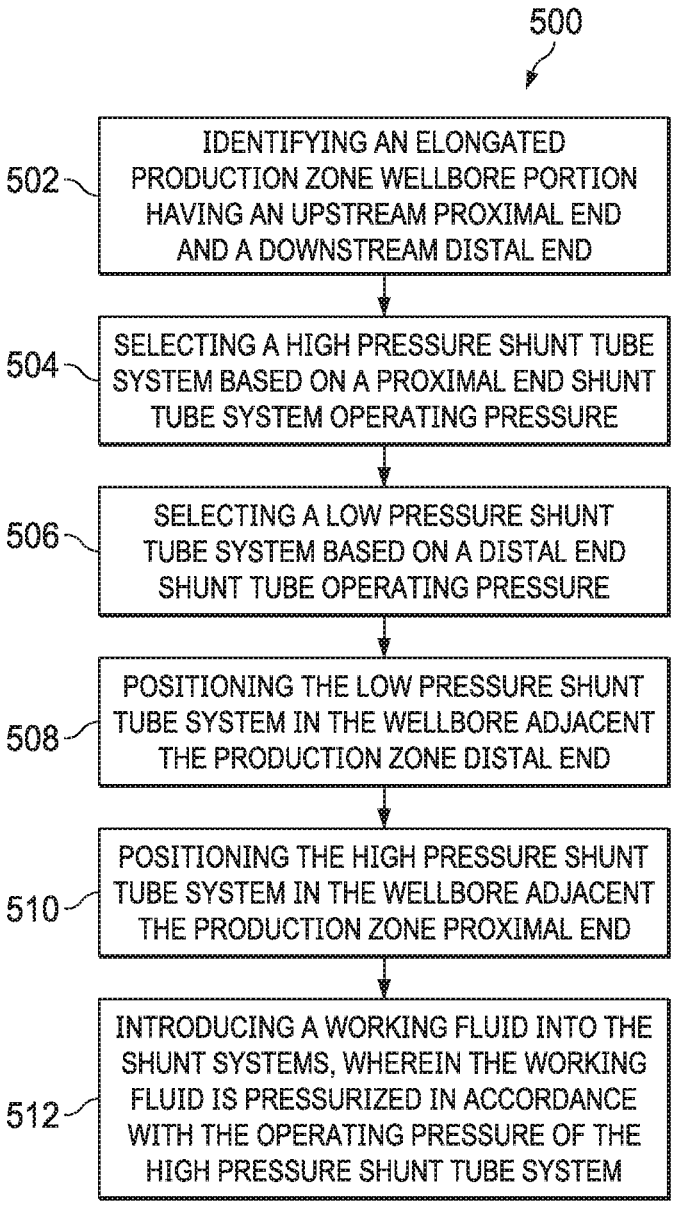
FIG. 5 is a method of installing in a wellbore a lower completion assembly having shunt tube systems with different pressure ratings.

Turning to FIG. 5, a method 500 of installing a completion assembly in a wellbore is generally illustrated. In a first step 502, a portion of the wellbore passing through a production zone to be gravel packed is identified for placement of a lower production assembly. The production zone portion of the wellbore can be characterized as having an upstream proximal end closest to the wellhead along the wellbore measured depth (MD) and a downstream distal end farthest from the wellhead in terms of MD. In step 504, the surface injection pressure necessary to deliver a gravel packing slurry to the most distal end of the production zone portion of the wellbore is determined, and based on this injection pressure, a high pressure shunt tube system to be positioned adjacent the proximal end of the production zone portion of the wellbore is selected for incorporation in a first or upstream sand screen assembly as described above. In step 506, the anticipated gravel pack slurry pressure at the distal end of the production zone portion of the wellbore is calculated, and based on this anticipated pressure, a low pressure shunt tube system to be positioned adjacent the distal end of the production zone portion of the wellbore is selected for incorporation in a second or downstream sand screen assembly as described above. Having selected the two sandscreen assemblies with their respective relative high pressure and low pressure shunt tube systems, the lower completion assembly can be made up into a tubing string by joining the first and second sandscreen assemblies together. In this regard, the base pipes of the assemblies are interconnected, and likewise, as described above, adjacent shunt tube assemblies are interconnected using jump tubes to establish fluid communication therebetween. In particular, the packing tube of an upstream sand screen assembly is interconnected to the shunt tube junction block of a downstream sandscreen assembly.

It will be appreciated that in one or more embodiments, the lower completion assembly will be made up of a plurality of sand screen assemblies, each carrying one or more shunt tube assemblies.

In such case, it will be necessary to estimate the grave pack slurry injection pressure profile along the length of the production zone portion of the wellbore, and then select the appropriate number of first or second sandscreen assemblies for makeup into the tubing string, it being understood at used here that "first" sandscreen assemblies refers to those sandscreen assemblies with a high pressure shunt system and "second" sandscreen assemblies refers to those sandscreen assemblies with a low pressure shunt system. For example, a lower production assembly may be comprised of 10 first sandscreen assemblies and 15 second sandscreen assemblies, all joined end-to-end to form the tubing string.

In any event, once lower production assembly having the desired number of first and second sandscreen assemblies is assembled, the lower production assembly is installed in the production zone portion of the wellbore. In so doing, at step 508, the second sandscreen assembly is deployed at the distal end of the wellbore portion so that the low pressure shunt tube system is positioned in the wellbore adjacent the production zone distal end. Likewise, in step 510, in positioning the low pressure shunt tube system, the first sandscreen assembly is deployed at the proximal end of the wellbore portion. In so doing, the high pressure shunt tube system is accordingly positioned adjacent the production zone proximal end.

Lastly, in step 512, a working fluid, such as a gravel pack slurry, gel or other desired fluid, is pumped into the interconnected shunt tube assemblies. The working fluid may be pressurized in accordance with the operating pressure of the high pressure shunt tube system deployed adjacent the upper end of the wellbore production zone. Because the pressure of the working fluid drops along the length of the production zone, only those "first" sandscreen assemblies are subjected to the higher pressure working fluid, whereas the "second" sandscreen assemblies are only subject to the lower pressure working fluid. Moreover, in certain embodiments, because of the shunt tube system geometry of the "first" sandscreen assemblies, leak-off at the higher pressure is minimized in the upper sandscreen assemblies, thereby minimizing the likelihood of blockage along the shunt tube system or in the gravel pack adjacent the packing tubes. In any event, the working fluid is pumped into the interconnected shunt tube assemblies and injected via the nozzles of the packing tubes into the annulus around the lower production assembly. To the extent the working fluid is a gravel pack slurry, a gravel pack is formed around the lower production assembly so as to support the formation and/or filter production fluids before introduction into the production tubing of the system.

Thus, a wellbore completion assembly has been described. The completion assembly may include a first sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube extending from a junction block where each of the tubes has a passageway defined therein, the packing tube further including a plurality of nozzles spaced apart from the junction block and from each other, wherein each of the tubes and each nozzle has a cross-sectional flow area; a second sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube extending from a junction block, the packing tube including a plurality of nozzles spaced apart from the junction block and from each other, wherein each of the tubes and each nozzle has a cross-sectional flow area; wherein the first and second sand screen assemblies are arranged end to end relative to one another so that the base pipes are in fluid communication with one another and the transport tubes are in fluid communication with one another; and wherein a cross-sectional flow area of the packing tube passageway in the first sand screen assembly is less than a cross-sectional flow area of the packing tube passageway in the second sand screen assembly. In other embodiments, the completion assembly may include a first sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube, where each of the tubes has a passageway defined therein, the packing tube further including a plurality of nozzles spaced apart from each other, wherein each of the tubes and each nozzle has a cross-sectional flow area; a second sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube, the packing tube including a plurality of nozzles spaced apart from each other, wherein each of the tubes and each nozzle has a cross-sectional flow area; wherein the first and second sand screen assemblies are arranged end to end relative to one another so that the base pipes are in fluid communication with one another and the transport tubes are in fluid communication with one another; wherein a cross-sectional flow area of the packing tube passageway in the first sand screen assembly is less than a cross-sectional flow area of the packing tube passageway in the second sand screen assembly. In other embodiments, the completion assembly may include a first sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube, where each of the tubes has a passageway defined therein, the packing tube further including a plurality of nozzles spaced apart from each other, wherein each of the tubes and each nozzle has a cross-sectional flow area; a second sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube, the packing tube including a plurality of nozzles spaced apart from each other, wherein each of the tubes and each nozzle has a cross-sectional flow area; wherein the first and second sand screen assemblies are arranged end to end relative to one another so that the base pipes are in fluid communication with one another and the transport tubes are in fluid communication with one another; wherein a cross-sectional flow area of the transport tube passageway in the first sand screen assembly is less than a cross-sectional flow area of the transport tube passageway in the second sand screen assembly. In other embodiments, the completion assembly may include a first sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube extending from a junction block where each of the tubes has a passageway defined therein, the packing tube further including a plurality of nozzles spaced apart from the junction block and from each other, wherein each of the tubes and each nozzle has a cross-sectional flow area; a second sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube extending from a junction block, the packing tube including a plurality of nozzles spaced apart from the junction block and from each other, wherein each of the tubes and each nozzle has a cross-sectional flow area; wherein the first and second sand screen assemblies are arranged end to end relative to one another so that the base pipes are in fluid communication with one another and the transport tubes are in fluid communication with one another; and wherein a cross-sectional flow area of the packing tube nozzle opening in the first sand screen assembly is less than a cross-sectional flow area of the packing tube nozzle opening in the second sand screen assembly. Other embodiments may include a first sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube extending from a junction block where each of the tubes has a passageway defined therein, the packing tube further including a plurality of nozzles spaced apart from the junction block and from each other, wherein each of the tubes and each nozzle has a cross-sectional flow area; a second sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube extending from a junction block, the packing tube including a plurality of nozzles spaced apart from the junction block and from each other, wherein each of the tubes and each nozzle has a cross-sectional flow area; wherein the first and second sand screen assemblies are arranged end to end relative to one another so that the base pipes are in fluid communication with one another and the transport tubes are in fluid communication with one another; and wherein the distance between the junction block and the packing tube nozzles is greater in the first sand screen assembly than the distance between the junction block and the packing tube nozzles in the second sand screen assembly. Still yet other embodiments of the wellbore completion assembly may include a first sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube extending from a junction block where each of the tubes has a passageway defined therein, the packing tube further including a plurality of nozzles spaced apart from the junction block and from each other, wherein each of the tubes and each nozzle has a cross-sectional flow area; a second sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube extending from a junction block, the packing tube including a plurality of nozzles spaced apart from the junction block and from each other, wherein each of the tubes and each nozzle has a cross-sectional flow area; wherein the first and second sand screen assemblies are arranged end to end relative to one another so that the base pipes are in fluid communication with one another and the transport tubes are in fluid communication with one another; and wherein the distance between adjacent packing tube nozzles is greater in the first sand screen assembly than the distance between adjacent packing tube nozzles in the second sand screen assembly. Still yet other embodiments may include a first sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube extending from a junction block where each of the tubes has a passageway defined therein, the packing tube further including a plurality of nozzles spaced apart from the junction block and from each other, wherein each of the tubes and each nozzle has a cross-sectional flow area; a second sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube extending from a junction block, the packing tube including a plurality of nozzles spaced apart from the junction block and from each other, wherein each of the tubes and each nozzle has a cross-sectional flow area; wherein the first and second sand screen assemblies are arranged end to end relative to one another so that the base pipes are in fluid communication with one another and the transport tubes are in fluid communication with one another; and wherein the number of packing tube nozzles in the first sand screen assembly is less than the number of packing tube nozzles in the second sand screen assembly. Other embodiments of the wellbore completion assembly may include a first sand screen assembly attached to a second sand screen assembly, wherein the first sand screen assembly comprises a shunt tube assembly with a first burst pressure and the second sand screen assembly comprises a shunt tube assembly with a burst pressure less than the first burst pressure. Other embodiments of the wellbore completion assembly may include a first sand screen assembly attached to a second sand screen assembly, wherein the first sand screen assembly comprises a shunt tube assembly disposed to operate at pressures over 5000 psi and the second sand screen assembly has a shunt tube assembly disposed to operate at pressures of no more than 5000 psi. Other embodiments of the wellbore completion assembly may include a plurality of first sand screen assemblies forming a lower portion of the completion assembly and attached to a plurality of second sand screen assemblies forming an upper portion of the completion assembly, wherein the first sand screen assemblies each comprises a shunt tube assembly having an operating pressure rating over 5000 psi and the second sand screen assembly has a shunt tube assembly having an operating pressure rating of no more than 5000 psi. In other embodiments, the wellbore completion assembly may include a first sand screen assembly attached to a second sand screen assembly, wherein the first sand screen assembly comprises a shunt tube assembly with a first operational pressure rating and the second sand screen assembly comprises a shunt tube assembly with a second operational pressure rating less than the first operational pressure rating. In other embodiments, the wellbore completion assembly may include a first sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube, where each of the tubes has a passageway defined therein, the packing tube further including a plurality of nozzles spaced apart from each other, wherein each of the tubes and each nozzle has a cross-sectional flow area; a second sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube, the packing tube including a plurality of nozzles spaced apart from each other, wherein each of the tubes and each nozzle has a cross-sectional flow area; wherein the first and second sand screen assemblies are arranged end to end relative to one another so that the base pipes are in fluid communication with one another and the transport tubes are in fluid communication with one another; wherein the transport tube of the first sand screen assembly is formed of a first material and the transport tube of the second sand screen assembly is formed of a second material, the first material having a greater tensile strength than the second material.

For any of the foregoing embodiments, one or more of the following elements may be combined alone therewith or with of the other following elements:

- Transport tube of the first sand screen assembly has a wall thickness greater than a wall thickness of a transport tube of the second sandscreen assembly.
- Packing tube of the first sand screen assembly has a wall thickness greater than a wall thickness of a packing tube of the second sandscreen assembly.
- Transport tube of the first sand screen assembly is formed of a first material and transport tube of the second sandscreen assembly is formed of a second material, where the first material is stronger than the second material.
- Transport tube of the first sand screen assembly is formed of a first material and transport tube of the second sandscreen assembly is formed of a second material, where the first material has a higher tensile strength than the second material.
- Transport tube of the first sand screen assembly is formed of a first material and transport tube of the second sandscreen assembly is formed of a second material, where the first material has a higher yield strength than the second material.
- Packing tube of the first sand screen assembly is formed of a first material and packing tube of the second sandscreen assembly is formed of a second material, where the first material is stronger than the second material.
- Packing tube of the first sand screen assembly is formed of a first material and packing tube of the second sandscreen assembly is formed of a second material, where the first material has a higher tensile strength than the second material.
- Packing tube of the first sand screen assembly is formed of a first material and packing tube of the second sandscreen assembly is formed of a second material, where the first material has a higher yield strength than the second material.
- A cross-sectional flow area of the packing tube passageway in the first sand screen assembly is less than a cross-sectional flow area of the packing tube passageway in the second sand screen assembly.
- A cross-sectional flow area of the packing tube nozzle opening in the first sand screen assembly is less than a cross-sectional flow area of the packing tube nozzle opening in the second sand screen assembly.
- The distance between the junction block and the packing tube nozzles is greater in the first sand screen assembly than the distance between the junction block and the packing tube nozzles in the second sand screen assembly.
- The distance between adjacent packing tube nozzles is greater in the first sand screen assembly than the distance between adjacent packing tube nozzles in the second sand screen assembly.
- The number of packing tube nozzles in the first sand screen assembly is less than the number of packing tube nozzles in the second sand screen assembly.
- The cross-sectional flow areas of the passageway in the first and second transport tubes is substantially the same.
- The cross-sectional flow areas of the first and second transport tubes is substantially round.
- The cross-sectional flow areas of the first and second transport tubes is substantially rectangular.
- The cross-sectional flow areas of the first and second transport tubes is oval shaped.
- The second end of the first sand screen assembly base pipe is connected to the first end of the second sand screen assembly base pipe forming a joint therebetween, the completion assembly further comprising an coupling interconnecting one end of a jumper tube to the transport tube of the first sand screen assembly, the other end of the jumper tube in fluid communication with the junction block of the second sand screen assembly whereby the jumper tube straddles the joint between the first and second sand screen assemblies.
- At least two screen assemblies each comprise a shunt tube assembly having first and second sets of transport tube and packing tubes, wherein each set of tubes extends from a junction block.
- The first sand screen assembly has a shunt tube assembly with a pressure rating of over 5000 psi and the second sand screen assembly has a shunt tube assembly with a pressure rating of no more than 5000 psi.
- The first sand screen assembly has a shunt tube assembly with a pressure rating of between 5000 and 10000 psi and the second sand screen assembly has a shunt tube assembly with a pressure rating of less than 5000 psi.
- The first sand screen assembly has a shunt tube assembly with a pressure rating of over a select threshold and the second sand screen assembly has a shunt tube assembly with a pressure rating of no more than the select threshold.
- The first sand screen assembly further comprises a junction block from which the transport tube and the packing tube extend, the plurality of nozzles being spaced apart from the junction block; and wherein the second sand screen assembly further comprises a junction block from which the transport tube and the packing tube extend, the plurality of nozzles being spaced apart from the junction block, wherein the distance between the first sand screen assembly junction block and the packing tube nozzles is greater in the first sand screen assembly than the distance between the second sand screen assembly junction block and the packing tube nozzles in the second sand screen assembly.

A method of installing a completion assembly in a wellbore has been described. The installation method may include installing a lower sand screen assembly having a low pressure shunt tube system in a wellbore adjacent a production zone; and attaching an upper sand screen assembly having a high pressure shunt tube system to the lower sand screen assembly upstream of the lower sand screen assembly. Other embodiments of the method may include installing a first sand screen assembly in a wellbore adjacent a production zone; and attaching a second sand screen assembly to the first sand screen assembly upstream of the first sand screen assembly, wherein the first sand screen assembly has a low pressure shunt tube system and the second sand screen assembly has a high pressure shunt tube system. Still yet other embodiments of the method may include installing a plurality of interconnected first sand screen assemblies in a wellbore adjacent a production zone; and attaching a plurality of second sand screen assemblies to the uppermost first sand screen assembly upstream of the first sand screen assemblies, wherein each first sand screen assembly has a low pressure shunt tube system and each second sand screen assembly has a high pressure shunt tube system. Yet other methods of the installation method may include identifying an elongated production zone having an upstream proximal end and a downstream distal end; determining a shunt tube system operating pressure associated with the proximal end of the production zone and selecting a high pressure shunt tube system based on the proximal end determined pressure; determining a shunt tube system operating pressure associated with the distal end of the production zone and selecting a low pressure shunt tube system based on the distal end determined pressure, wherein the low pressure shunt tube system has a lower shunt tube operating pressure than the high pressure shunt tube system; positioning the low pressure shunt tube system in the wellbore adjacent the production zone distal end; and positioning the high pressure shunt tube system in the wellbore adjacent the production zone proximal end. Likewise, other installation methods may include identifying an elongated production zone wellbore portion having an upstream proximal end and a downstream distal end; selecting a high pressure shunt tube system based on a proximal end shunt tube system operating pressure; selecting a low pressure shunt tube system based on a distal end shunt tube system operating pressure; positioning the low pressure shunt tube system in the wellbore adjacent the production zone distal end; positioning the high pressure shunt tube system in the wellbore adjacent the production zone proximal end; introducing a working fluid into the shunt systems, wherein the working fluid is pressurized in accordance with the operating pressure of the high pressure shunt tube system.

For any of the foregoing embodiments, one or more of the following elements may be combined alone therewith or with of the other following elements:

The high pressure shunt tube system is disposed to operate at pressures of 5000 psi and the low pressure shunt tube system is disposed to operate at pressures of no more than 5000.

The high pressure shunt tube system is disposed to operate at pressures above a select threshold and the low pressure shunt tube system is disposed to operate at pressures of no more than the select threshold.

Introducing a working fluid into the shunt systems, wherein the working fluid is pressurized in accordance with the operating pressure of the high pressure shunt tube system.

Injecting the working fluid into the annulus adjacent the shunt tube system so as to form a gravel pack in the annulus.

What is claimed is:

1. A completion assembly for deployment in a wellbore, the completion assembly comprising:

a first sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube, where each of the tubes has a passageway defined therein, the packing tube further including a plurality of nozzles spaced apart from each other, wherein each of the tubes and each nozzle has a cross-sectional flow area;

a second sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube, the packing tube including a plurality of nozzles spaced apart from each other, wherein each of the tubes and each nozzle has a cross-sectional flow area;

a source of pressurized working fluid fluidly coupled to an upstream end of the transport tube of the first sand screen assembly;

wherein the first and second sand screen assemblies are arranged end to end relative to one another so that the base pipes are in fluid communication with one another and the transport tubes are in fluid communication with one another such that the transport tube of the second sand screen assembly is fluidly coupled to the source of pressurized working fluid downstream of the transport tube of the first sand screen assembly; and wherein the transport tube of the first sand screen assembly has a first wall thickness and the transport tube of the second sand screen assembly has a second wall thickness, the first wall thickness being greater than the second wall thickness.

2. The completion assembly of claim 1, wherein a cross-sectional flow area of the packing tube nozzle opening in the first sand screen assembly is less than a cross-sectional flow area of the packing tube nozzle opening in the second sand screen assembly.

3. The completion assembly of claim 1, wherein the first sand screen assembly further comprises a junction block from which the transport tube and the packing tube extend, the plurality of nozzles being spaced apart from the junction block; and wherein the second sand screen assembly further comprises a junction block from which the transport tube and the packing tube extend, the plurality of nozzles being spaced apart from the junction block, wherein the distance between the first sand screen assembly junction block and the packing tube nozzles is greater in the first sand screen assembly than the distance between the second sand screen assembly junction block and the packing tube nozzles in the second sand screen assembly.

4. The completion assembly of claim 1, wherein the number of packing tube nozzles in the first sand screen assembly is less than the number of packing tube nozzles in the second sand screen assembly.

5. The completion assembly of claim 1, wherein the cross-sectional flow areas of the passageway in the first and second transport tubes is the same.

6. The completion assembly of claim 1, wherein the second end of the first sand screen assembly base pipe is connected to the first end of the second sand screen assembly base pipe forming a joint therebetween, the completion assembly further comprising a coupling interconnecting one end of a jumper tube to the transport tube of the first sand screen assembly, the other end of the jumper tube in fluid communication with the junction block of the second sand screen assembly whereby the jumper tube straddles the joint between the first and second sand screen assemblies.

7. The completion assembly of claim 1, wherein the shunt tube assembly of the first sand screen assembly has a pressure rating between 5000 psi and 10000 psi, and the shunt tube assembly of the second sand screen assembly has a pressure rating of no more than 5000 psi.

8. The completion assembly of claim 1, wherein the shunt tube assembly of the first sand screen assembly has a pressure rating of between 5000 and 10000 psi.

9. The completion assembly of claim 1, wherein the shunt tube assembly of the first sand screen assembly has a pressure rating of over a select threshold and the shunt tube assembly of the second sand screen assembly has a pressure rating of no more than the select threshold.

10. The completion assembly of claim 1, wherein the shunt tube assembly of the first sand screen assembly has a first burst pressure and the shunt tube assembly of the second sand screen assembly has a burst pressure less than the first burst pressure.

11. A completion assembly for deployment in a wellbore, the completion assembly comprising:

a source of pressurized working fluid;

a first sand screen assembly attached to a second sand screen assembly, wherein the first sand screen assembly comprises a shunt tube assembly with a first burst pressure and the second sand screen assembly comprises a shunt tube assembly with a burst pressure less than the first burst pressure, and wherein the shunt tube assembly with the first burst pressure is fluidly coupled between the source of pressurized working fluid and the shunt tube assembly with the burst pressure less than the first burst pressure.

12. The completion assembly of claim 11, wherein the shunt tube assembly of the first sand screen assembly is disposed to operate at pressures between 5000 psi and 10000 psi and the shunt tube assembly of the second sand screen assembly is disposed to operate at pressures of no more than 5000 psi.

13. The completion assembly of claim 11, further comprising:

a plurality of first sand screen assemblies forming a lower portion of the completion assembly and attached to a plurality of second sand screen assemblies forming an upper portion of the completion assembly, wherein the first sand screen assemblies each comprises a shunt tube assembly having an operating pressure rating between 5000 psi and 10000 psi, and the second sand screen assembly has a shunt tube assembly having an operating pressure rating of no more than 5000 psi.

14. A method of installing a completion assembly in a wellbore, the method comprising:

identifying an elongated production zone having an upstream proximal end and a downstream distal end with respect to a source of pressurized working fluid;

determining a shunt tube system operating pressure associated with the proximal end of the production zone and selecting a high pressure shunt tube system based on the proximal end determined pressure;

determining a shunt tube system operating pressure associated with the distal end of the production zone and selecting a low pressure shunt tube system based on the distal end determined pressure;

installing a first sand screen assembly in a wellbore adjacent the distal downstream end of the elongated production zone;

attaching a second sand screen assembly to the first sand screen assembly at the proximal upstream end of the elongated production zone, wherein the first sand screen assembly has the low pressure shunt tube system and the second sand screen assembly has the high pressure shunt tube system, such that a downstream end of the high pressure shunt tube system is coupled to an upstream end of the low pressure shunt tube system; and coupling the source of pressurized working fluid to an upstream end of the high pressure shunt tube system.

15. The method of claim 14, further comprising: installing a plurality of interconnected first sand screen assemblies in a wellbore adjacent the production zone;

and attaching a plurality of second sand screen assemblies to an uppermost first sand screen assembly upstream of the first sand screen assemblies.

16. The method of claim 14, further comprising introducing a working fluid into the shunt systems, wherein the working fluid is pressurized in accordance with the operating pressure of the high pressure shunt tube system.

17. The method of claim 16, further comprising injecting the working fluid into the annulus adjacent the shunt tube system so as to form a gravel pack in the annulus.

18. The method of claim 14, wherein the high pressure shunt tube system is disposed to operate at pressures of 5000 psi and the low pressure shunt tube system is disposed to operate at pressures of no more than 5000.

19. The method of claim 14, wherein the high pressure shunt tube system is disposed to operate at pressures above a select threshold and the low pressure shunt tube system is disposed to operate at pressures of no more than the select threshold.

20. The method of claim 14, wherein installing the first sand screen assembly and attaching the second sand screen assembly include disposing the first sand screen assembly and the second sand screen assembly in a horizontal portion of the wellbore.

21. A completion assembly for deployment in a wellbore, the completion assembly comprising:

a source of pressurized working fluid;

a first sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube, where each of the tubes has a passageway defined therein, the packing tube further including a plurality of nozzles spaced apart from each other, wherein each of the tubes and each nozzle has a cross-sectional flow area; and a second sand screen assembly comprising a base pipe having perforations therein and extending between a first end and a second ends, a sand screen disposed around a portion of the base pipe, and a shunt tube assembly disposed outwardly of the sand screen, the shunt tube assembly having a transport tube and a packing tube, the packing tube including a plurality of nozzles spaced apart from each other, wherein each of the tubes and each nozzle has a cross-sectional flow area;

wherein the first and second sand screen assemblies are arranged end to end relative to one another so that the base pipes are in fluid communication with one another and the transport tubes are in fluid communication with one another and the source of pressurized working fluid, the transport tube of the second sand screen assembly fluidly coupled to the source of pressurized working fluid downstream of the transport tube of the first sand screen assembly; and wherein the transport tube of the first sand screen assembly is formed of a first material and the transport tube of the second sand screen assembly is formed of a second material, the first material having a greater tensile strength than the second material.

22. The completion assembly of claim 21, wherein the transport tube of the first sand screen assembly has a first wall thickness and the transport tube of the second sand screen assembly has a second wall thickness, the first wall thickness being greater than the second wall thickness.

23. The completion assembly of claim 21, wherein the first sand screen assembly has a shunt tube assembly with a first pressure rating and the second sand screen assembly has a shunt tube assembly with a second pressure rating less than the first pressure rating.

* * * * *